US011482368B2

(12) United States Patent
Pal et al.

(10) Patent No.: US 11,482,368 B2
(45) Date of Patent: Oct. 25, 2022

(54) HYBRID THERMAL MANAGEMENT OF ELECTRONICS

(71) Applicant: Hamilton Sundstrand Corporation, Charlotte, NC (US)

(72) Inventors: Debabrata Pal, Hoffman Estates, IL (US); Ashutosh Joshi, Roscoe, IL (US); Mark W. Metzler, Davis, IL (US); Eric A. Carter, Monroe, WI (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 424 days.

(21) Appl. No.: 16/542,917

(22) Filed: Aug. 16, 2019

(65) Prior Publication Data

US 2021/0050138 A1 Feb. 18, 2021

(51) Int. Cl.

| | |
|---|---|
| ***H01F 27/10*** | (2006.01) |
| ***H01F 27/12*** | (2006.01) |
| ***H01F 27/02*** | (2006.01) |
| ***H01F 27/24*** | (2006.01) |
| ***H01F 27/28*** | (2006.01) |

(52) U.S. Cl.

CPC ..... *H01F 27/12* (2013.01); *H01F 27/022* (2013.01); *H01F 27/24* (2013.01); *H01F 27/28* (2013.01)

(58) Field of Classification Search

CPC ..... H01F 27/12; H01F 27/022; H01F 27/24; H01F 27/28; H01F 27/10; H01F 27/22; H01F 27/23; H01F 27/2876; H01F 27/2895; H01F 27/025

See application file for complete search history.

(56) References Cited

U.S. PATENT DOCUMENTS 5,363,002 A 11/1994 Hernden et al.
5,519,269 A 5/1996 Lindberg
(Continued)

FOREIGN PATENT DOCUMENTS

CN 102956350 A 3/2013
EP 2858076 A1 4/2015
(Continued)

OTHER PUBLICATIONS

Extended European Search Report dated Feb. 13, 2020, issued during the prosecution of European Patent Application No. EP 19212337.

*Primary Examiner* — Tuyen T Nguyen

(74) *Attorney, Agent, or Firm* — Locke Lord LLP; Scott D. Wofsy; Alicia J. Carroll

(57) ABSTRACT

A transformer assembly includes a housing, a core within an interior of the housing, and at least one winding positioned around the core. The at least one winding and the core are mounted to the housing with potting material. At least a portion of a fluid circuit is defined within at least one wall of the housing. The at least the portion of the fluid circuit is defined through an opening in the at least one wall of the housing in fluid communication with the interior of the housing. A transformer assembly includes a housing, a core within an interior of the housing, at least one winding positioned around the core, and a fluid circuit defined at least partially within at least one wall of the housing being configured such that heat is transferred to the fluid from at least one of the core and the at least one winding.

11 Claims, 3 Drawing Sheets

(56) References Cited

U.S. PATENT DOCUMENTS

| | | | | |
|---|---|---|---|---|
| 7,075,399 | B2 | 7/2006 | Saban et al. | |
| 7,709,980 | B2 | 5/2010 | Dooley | |
| 9,299,488 | B2 * | 3/2016 | Shepard | H01F 27/2876 |
| 9,373,436 | B2 * | 6/2016 | Pal | H01F 27/10 |
| 9,748,822 | B2 | 8/2017 | Pal | |
| 2009/0322460 | A1 * | 12/2009 | Lin | H01F 30/16 336/62 |

FOREIGN PATENT DOCUMENTS

| | | | | |
|---|---|---|---|---|
| EP | 3499524 | A1 | 6/2019 | |
| WO | WO-2011061207 | A1 * | 5/2011 | H01F 27/085 |

* cited by examiner

HYBRID THERMAL MANAGEMENT OF ELECTRONICS

BACKGROUND OF THE INVENTION

1. Field of the Invention

The present disclosure relates to heat transfer in transformer assemblies, and more particularly to cooling transformer assemblies.

2. Description of Related Art

It is known that electrical power systems, and specifically transformer windings and core, generate waste heat during their operation. This heat, if not properly managed, can result in electrical component failure, leading to early repair and replacement of the electronic components. Efficient thermal management is important for achieving high reliability for the transformer windings and core under extreme environment conditions. For example, typical systems for removing heat from windings and core of a transformer have employed a physical heat sink which draws the heat away from the windings and allows the heat to dissipate. Such a system can use potting material and cold plates to facilitate the dissipation of heat.

The conventional techniques have been considered satisfactory for their intended purpose. However, there is an ever present need for improved thermal management in transformer assemblies. This disclosure provides a solution for this need.

SUMMARY

A transformer assembly includes a housing, a core within an interior of the housing, and at least one winding positioned around the core. The at least one winding and the core are mounted to the housing with potting material. At least a portion of a fluid circuit is defined within at least one wall of the housing. The at least the portion of the fluid circuit is defined through an opening in the at least one wall of the housing in fluid communication with the interior of the housing.

The opening can be configured to spray fluid onto an outer surface of the at least one winding within the interior of the housing. The potting material can be positioned between the at least one winding and a top wall of the housing. The opening can include an orifice. The opening can include a nozzle. The assembly can include an erosion resistant coating on an outer surface of the at least one winding. The assembly can include a fluid return port defined in a bottom wall of the housing.

In accordance with another aspect, a method of cooling a transformer assembly includes directing a cooling fluid to flow through a fluid circuit defined within at least one wall of a housing. The method includes directing the cooling fluid from an opening of the at least one wall of the housing toward at least one winding within an interior of the housing. The at least one winding is positioned around a core. The at least one winding and the core are mounted to the housing with potting material In some embodiments, directing the cooling fluid includes spraying the cooling fluid onto an outer surface of the at least one winding within the interior of the housing. The potting material can be positioned between the at least one winding and a top wall of the housing. The opening can include an orifice. The opening can include a nozzle. An outer surface of the at least one winding can include an erosion resistant coating. The method can include returning the cooling fluid from the interior of the housing to a return port of the housing by way of a fluid return opening defined in a bottom wall of the housing.

In accordance with another aspect, a transformer assembly includes a housing, a core within an interior of the housing, at least one winding positioned around the core, and a fluid circuit defined at least partially within at least one wall of the housing being configured such that heat is transferred to the fluid from at least one of the core and the at least one winding.

The at least one wall of the housing can include an opening configured to spray fluid onto an outer surface of the at least one winding within the interior of the housing. The opening can include an orifice or a nozzle. Potting material can be positioned between the at least one winding and a top wall of the housing. The assembly can include an erosion resistant coating on an outer surface of the at least one winding.

These and other features of the systems and methods of the subject disclosure will become more readily apparent to those skilled in the art from the following detailed description of the preferred embodiments taken in conjunction with the drawings.

DETAILED DESCRIPTION

Figure 1:
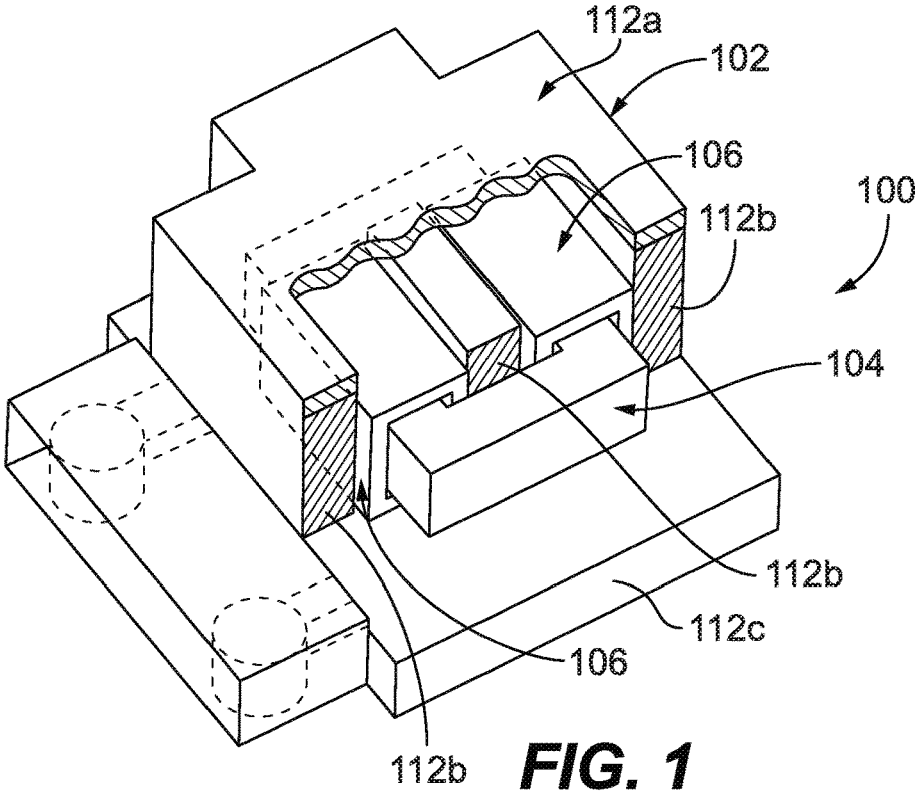
FIG. 1 is a schematic depiction of a perspective view of an embodiment of a portion of a transformer assembly constructed in accordance with the present disclosure, showing a portion of the housing cut-away to show the core and windings of the transformer.

Reference will now be made to the drawings wherein like reference numerals identify similar structural features or aspects of the subject disclosure. For purposes of explanation and illustration, and not limitation, a partial view of an exemplary embodiment of an transformer in accordance with the disclosure is shown in FIG. 1 and is designated generally by reference character 100. Other embodiments of transformers in accordance with the disclosure, or aspects thereof, are provided in FIGS. 2-6, as will be described. The systems and methods described herein can be used for providing more efficient and effective cooling of transformer assemblies.

Figure 2:
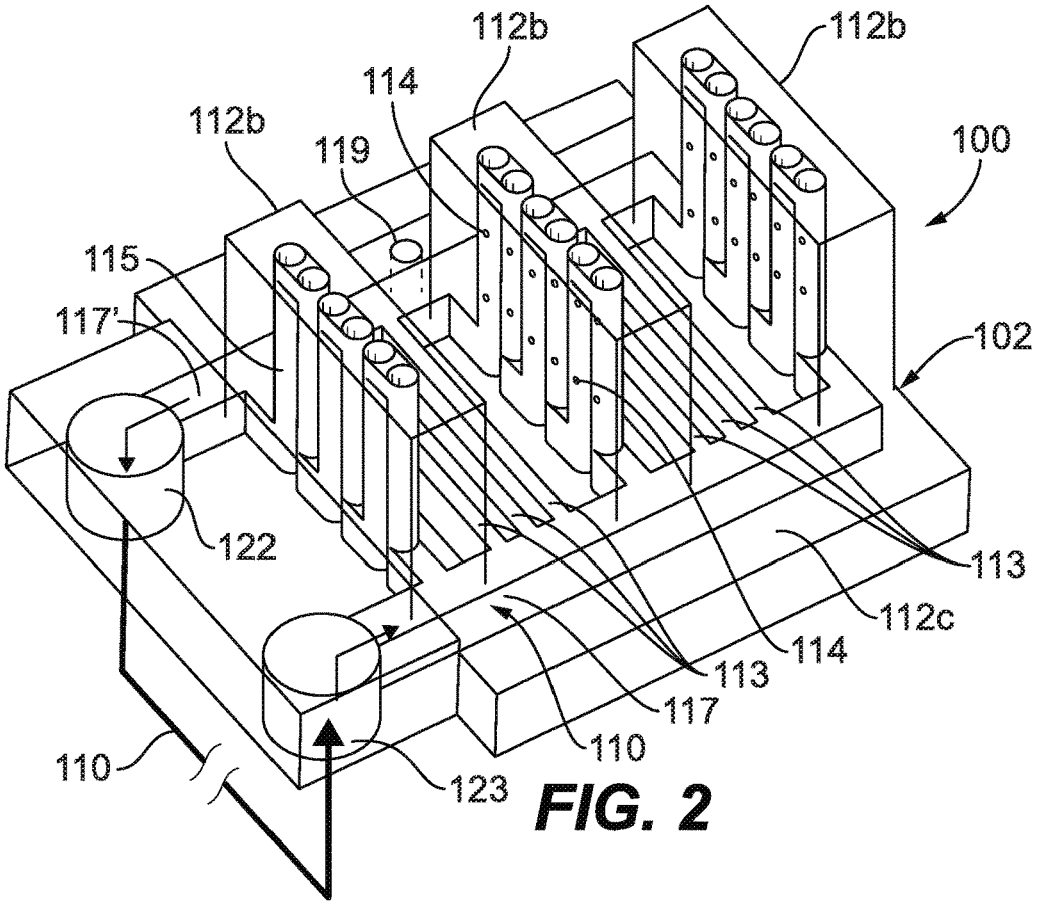
FIG. 2 is a schematic depiction of a perspective view of the transformer assembly of FIG. 1, showing the fluid circuit of the transformer assembly within the transformer housing walls.
Figure 3:
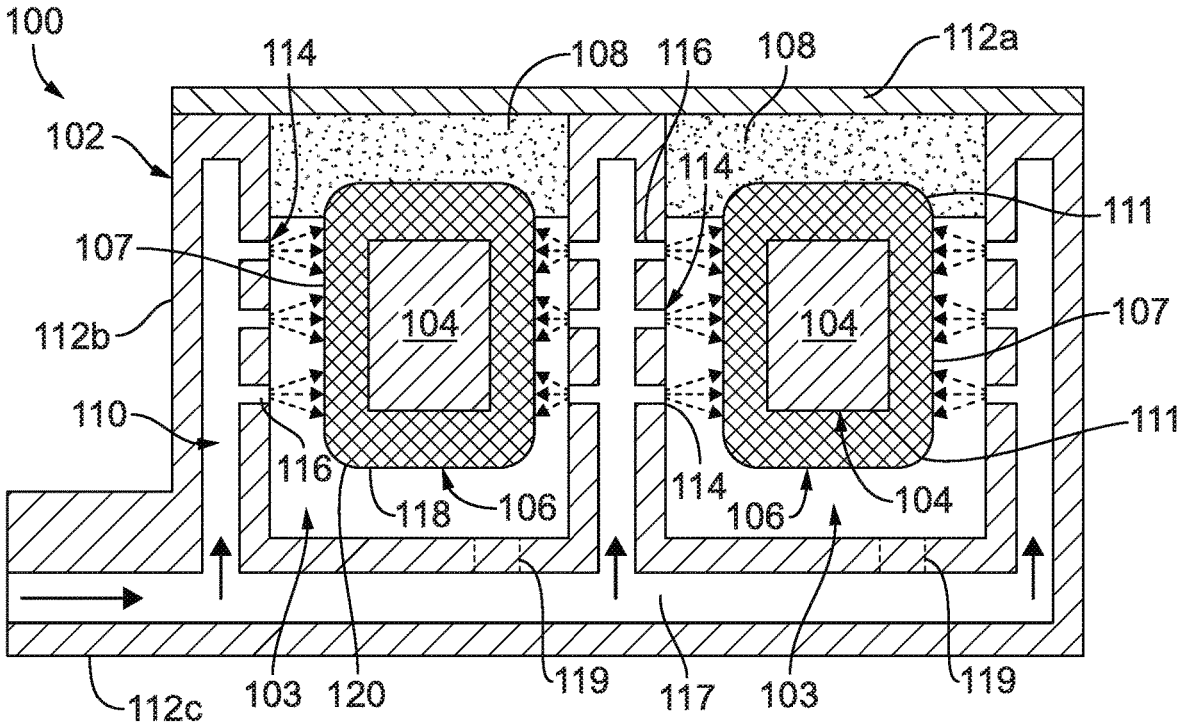
FIG. 3 is a schematic depiction of a side view of the transformer assembly of FIG. 1, showing openings in the housing, the core, and the windings wrapped around the core.

As shown in FIG. 1-3, a transformer assembly 100 includes a housing 102, e.g. a transformer housing, a core 104 within an interior 103 of transformer housing 102, and windings 106 positioned, e.g. wrapped, around the core 104. As shown in FIG. 1, core 104 is annular in shape and a wall 112*b* of the housing 112 is positioned in the middle of the annular core 104. The partial cross-sectional views of housing walls 112*b* are shown without vertical channels 115 in FIG. 1 for sake of clarity. Core 104 is shown schematically as a rectangular annulus (e.g. an annulus having a rectangular cross-section). Those skilled in the art will readily appreciate that the annulus can have a circular cross-section (e.g. donut shaped) or the like. In FIG. 1, two windings 106 are shown. Each winding 106 can be wrapped around a respective opposite leg of the core 104. The windings 106 and the core 104 are mounted to the transformer housing 102 with potting material 108. Transformer heat is generated on windings 106 and core 104. Efficient thermal management is important for achieving high reliability for transformer assembly 100. Potting material 108 is positioned between the windings 106 and a top wall 112*a*, e.g. a cover, of the transformer housing 102 to conduct heat from windings 106 and core 104 to top wall 112, to side walls 112*b*, and/or to bottom wall 112*c* (which acts as a cold plate). While each winding 106 is shown schematically as a block surrounding respective opposing legs of core 104, those skilled in the art will readily appreciate that windings 106 can each be made up of a plurality of wires wrapped around core 104.

With continued reference to FIGS. 1-3, assembly 100 includes a fluid circuit 110 defined within the bottom wall 112*c* and side walls 112*b* of the transformer housing 102. For sake of clarity, the fluid circuit 110 is shown in solid lines in FIG. 2, but those skilled in the art will readily appreciate that the fluid circuit is defined within bottom wall 112*c* and side walls 112*b*. By utilizing a fluid circuit 110 to provide a cooling fluid to assembly 100, and thereby providing convection cooling, assembly 100 has a hybrid cooling scheme. The fluid circuit 110 defines a flow path (shown schematically by large arrows within fluid circuit 110) from a fluid inlet 123 in a bottom wall 112*c* of the transformer housing 102 to a fluid return port 122. Fluid return port 122 is defined in a bottom wall 112*c* of the transformer housing 102. In between fluid inlet port 123 and fluid return port 122 are two primary circuit legs 117 that extend longitudinally along the bottom wall 112*c*, a series of generally transverse horizontal channels 113 defined in the bottom wall 112*c* that connect primary circuit legs 117, and vertical channels 115. Each vertical channel 115 is defined in a separate side wall 112*b*. Those skilled in the art will readily appreciate that portions of vertical channel 115 may be considered horizontal as they are connecting to the primary circuit legs 117. Each vertical channel 115 includes alternating directions as it snakes upwards and downwards through its respective sidewall 112*b*. Side walls 112*b* and vertical channels 115 are defined in a plane that is generally perpendicular to the bottom wall 112*c*. While three horizontal channels 113 are shown between given side walls 112*b*, it is contemplated that a single channel or other numbers of channels can be used.

With continued reference to FIGS. 1-3, fluid circuit includes a cooling fluid, e.g. oil, to provide convection cooling (e.g. both forced and natural convection) to winding 106 while the potting material 108 provides conductive cooling and sealing of oil within transformer housing 102. Housing 102 includes a plurality of openings 114 in fluid communication with the interior 103 of transformer housing 102. Openings 114 are defined in sidewalls 112*b* and provide fluid communication between vertical channels 115 of fluid circuit 110 and an interior 103 of transformer housing 102 such that the fluid circuit 110 is defined, in part, through interior 103. The cooling fluid used in fluid circuit 110, e.g. a hot oil at about 105° C., operates to cool the wire insulations around the wires of windings 106 and core 104 to ensure that they stay at or below their rated temperature. In some cases, the wire insulations and core have a rating of around 180° C. or lower.

With reference now to FIGS. 2-3, openings 114 are configured to spray fluid onto an outer surface 120 of the windings 106 within the interior 103 of the transformer housing 102. Openings 114 direct fluid spray onto sides 107 of windings 106, in between end curves 111. In the embodiment of FIG. 2, openings 114 each define a nozzle 116. Each nozzle 116 provides a spray of cooling fluid, e.g. oil, into the interior 103 of transformer housing 102 to provide convection cooling, e.g. forced convection cooling. Cooling fluid, e.g. oil, is sprayed on winding surfaces to remove heat by convection. The spray can include air mixing. To avoid erosion of winding insulation, assembly 100 includes an erosion resistant coating 118, e.g. a thin layer of Nomex® (available from DuPont Safety & Construction, Inc.) and/or Kapton® (available from DuPont Electronics, Inc.) on an outer surface 120 of the sides of the windings 106. Once the cooling fluid is within the interior 103 of the transformer housing 102, the cooling fluid (and fluid circuit 110) exits to fluid return port 122 by way of a fluid return opening 119 defined in bottom wall 112*c* of housing 102. Fluid return opening 119 fluidically connects interior 103 of the transformer housing 102 with downstream leg 117' proximate to fluid return port 122 such that fluid can exit housing 102 via fluid return port 122.

Figure 4:
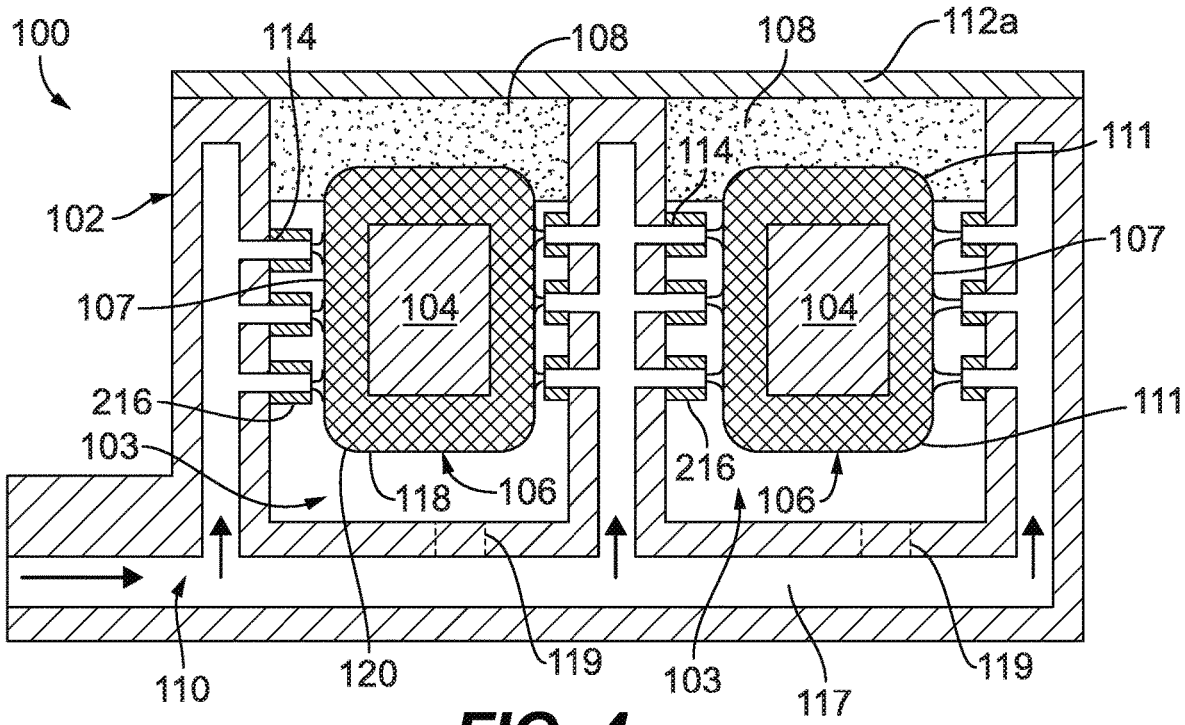
FIG. 4 is a schematic depiction of a side view of another embodiment of a portion of a transformer assembly constructed in accordance with the present disclosure, showing nozzles at the openings of the housing.
Figure 5:
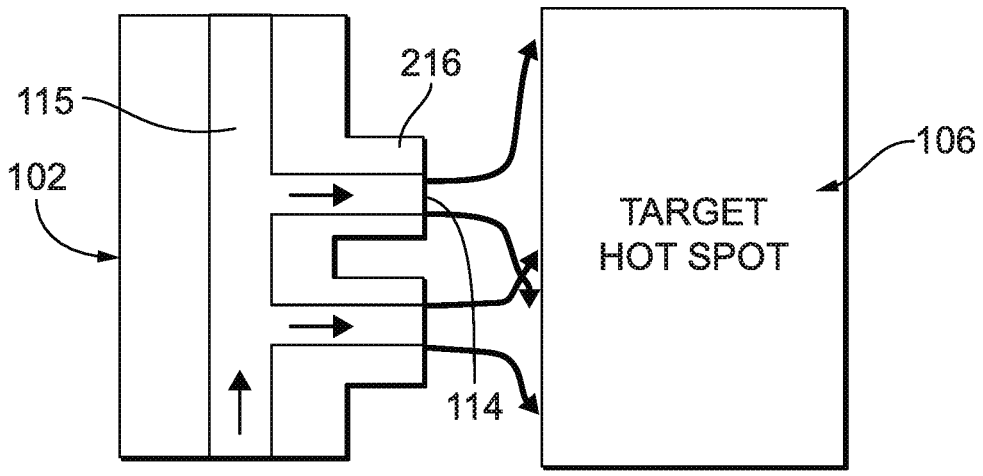
FIG. 5 is a schematic depiction of a side view of a portion of the transformer assembly of FIG. 4, showing the jet impingement of the cooling fluid on the target winding.
Figure 6:
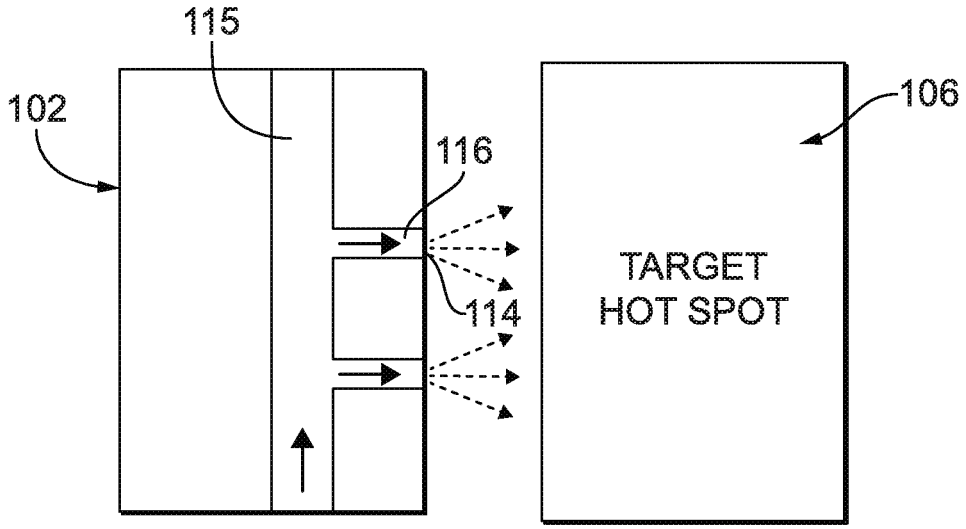
FIG. 6 is a schematic depiction of a side view of a portion of the transformer assembly of FIG. 3, showing the spray of the cooling fluid on the target winding.

With reference now to FIGS. 4-5, another embodiment of assembly 100 is shown. The embodiment of FIGS. 4-5 is the same as the embodiment of FIGS. 1-3, 6 and 8, except that the openings 114 include an orifice jet 216, e.g. an orifice for generating a high velocity oil jet, instead of a nozzle 116. The oil jet hits on winding surfaces to remove heat by jet impingement. Those skilled in the art will readily appreciate that heat transfer coefficients for impingement are 2-100 times that of general convection. In either embodiment, whether it is assembly of FIGS. 1-3, 6 and 8 or the assembly of FIGS. 4-5, the cooling fluid is sprayed and/or directed to the area of the windings 106 where most of the heat loss occurs.

A method of cooling a transformer assembly, e.g. transformer assembly 100, includes providing and urging a cooling fluid through a fluid circuit, e.g. fluid circuit 110, defined within at least one wall of a housing, e.g. transformer housing 102, and directing the cooling fluid from an opening, e.g. openings 114, of the fluid circuit toward at least one winding, e.g. windings 106, within an interior, e.g. interior 103, of the transformer housing. Directing the cooling fluid includes spraying the cooling fluid onto an outer surface, e.g. outer surface 120, of the windings within the interior of the transformer housing. Spraying can be by way of a nozzle, e.g. nozzle 116, or an orifice jet, e.g. orifice jet 216. The potting material is positioned between the windings and a top wall, e.g. top wall 112*a*, of the transformer housing. The method includes conductively cooling the windings and the core by using the potting material. In other words, the method includes both conductive cooling and convective cooling (by way of the fluid circuit). The method includes returning the cooling fluid from the interior of the transformer housing to a fluid return port, e.g. fluid return port 122, of the transformer housing by way of a fluid return opening, e.g. fluid return opening 119, defined in a bottom wall, e.g. bottom wall 112*c*, of the transformer housing. Those skilled in the art will readily appreciate that coolant exiting the port 122 (which has absorbed the heat from the conductive and convective cooling of the winding and core) can be cooled via an external heat exchanger or the like (not shown) and then returned to inlet port 123 to complete the fluid circuit 110. As shown schematically by the arrow between return port 122 and inlet port 123 in FIG. 2, a portion of the fluid circuit 110 can be outside of housing 102. Those skilled in the art will readily appreciate that a pump can be positioned on fluid circuit 110 external to housing 102 in order to provide pressure for fluid within fluid circuit 110. Transformer assemblies 100 in accordance with embodiments of the present disclosure provide improved overall cooling effectiveness. The temperature for the core and windings of assembly 100 of with the convective and conductive cooling in accordance with the present disclosure peaks at approximately 182° C., while windings and a core in a traditional assembly peaks at approximately 221° C.

The methods and systems of the present disclosure, as described above and shown in the drawings, provide for more targeted and efficient cooling of transformer assemblies that reduces windings/core temperatures, which results in increased reliability for the transformer assembly, the ability to dissipate larger amounts of power into smaller volumes, and reduced weight. While the apparatus, assemblies and methods of the subject disclosure have been shown and described with reference to preferred embodiments, those skilled in the art will readily appreciate that changes and/or modifications may be made thereto without departing from the scope of the subject disclosure.

What is claimed is:

1. A transformer assembly comprising:

a housing;

a core within an interior of the housing; and at least one winding positioned around the core, wherein the at least one winding and the core are mounted to the housing with potting material, wherein at least a portion of a fluid circuit is defined within an inner diameter sidewall and an outer diameter sidewall of the housing, wherein the inner diameter sidewall and outer diameter sidewall of the housing each include at least one opening configured to spray fluid onto an outer surface of the at least one winding within the interior of the housing.

2. The assembly as recited in claim 1, wherein the potting material is positioned between the at least one winding and a top wall of the housing.

3. The assembly as recited in claim 1, wherein the opening includes an orifice.

4. The assembly as recited in claim 1, wherein the opening includes a nozzle.

5. The assembly as recited in claim 1, further comprising an erosion resistant coating on an outer surface of the at least one winding.

6. The assembly as recited in claim 1, further comprising a fluid return port defined in a bottom wall of the housing.

7. A transformer assembly comprising:

a housing;

a core within an interior of the housing; and at least one winding positioned around the core, wherein at least a portion of a fluid circuit is defined within an inner diameter sidewall and an outer diameter sidewall of the housing being configured such that heat is transferred to fluid from at least one of the core and the at least one winding, wherein the inner diameter sidewall and outer diameter sidewall of the housing each include at least one opening configured to spray fluid onto an outer surface of the at least one winding within the interior of the housing.

8. The assembly as recited in claim 7, wherein the opening includes an orifice.

9. The assembly as recited in claim 7, wherein the opening includes a nozzle.

10. The assembly as recited in claim 7, wherein potting material is positioned between the at least one winding and a top wall of the housing.

11. The assembly as recited in claim 7, further comprising an erosion resistant coating on an outer surface of the at least one winding.

* * * * *